US010370077B1

(12) United States Patent
Day et al.

(10) Patent No.: US 10,370,077 B1
(45) Date of Patent: Aug. 6, 2019

(54) EXHAUST SPRAY INHIBITOR

(71) Applicant: Kathryn Marie Day, Lake Jackson, TX (US)

(72) Inventors: Kathryn Marie Day, Lake Jackson, TX (US); Russell Douglas Smith, Surfside, TX (US); Todd Sterling Tullis, League City, TX (US)

(73) Assignee: Kathryn Marie Day, Lake Jackson, TX (US)

( * ) Notice: Subject to any disclaimer, the term of this patent is extended or adjusted under 35 U.S.C. 154(b) by 0 days.

(21) Appl. No.: 15/872,949

(22) Filed: Jan. 16, 2018

(51) Int. Cl.

| | |
|---|---|
| ***B63H 21/34*** | (2006.01) |
| ***B63H 21/32*** | (2006.01) |
| ***F01N 13/08*** | (2010.01) |
| ***F01N 13/12*** | (2010.01) |
| ***F01N 13/00*** | (2010.01) |

(52) U.S. Cl.
CPC ..... *B63H 21/34* (2013.01); *B63H 21/32* (2013.01); *F01N 13/004* (2013.01); *F01N 13/08* (2013.01); *F01N 13/12* (2013.01); *F01N 2590/02* (2013.01)

(58) Field of Classification Search
CPC ..... B63H 21/00; B63H 21/32; B63H 21/34; B63J 2/00
USPC ..... 440/89 J, 89 R; 181/235, 238, 239, 240; 114/182, 183 R, 211
See application file for complete search history.

(56) References Cited

U.S. PATENT DOCUMENTS

| | | | | |
|---|---|---|---|---|
| 4,353,318 | A * | 10/1982 | Williams | B63J 2/06 114/211 |
| 5,046,977 | A * | 9/1991 | Rodskier | F01N 13/004 440/89 J |
| 5,591,058 | A * | 1/1997 | Schriever | B63H 21/34 440/89 R |
| 6,135,834 | A * | 10/2000 | Polakowski | B63H 21/32 440/89 J |
| 6,206,741 | B1 * | 3/2001 | Matsuda | B63H 21/32 440/89 J |
| 6,213,828 | B1 * | 4/2001 | Tsumiyama | B63H 21/32 440/89 J |
| 6,755,705 | B1 * | 6/2004 | Slattery | B63H 21/32 440/89 J |
| 2011/0011669 | A1 * | 1/2011 | Zelinski | F01N 13/004 181/235 |

* cited by examiner

*Primary Examiner* — Lars A Olson
(74) *Attorney, Agent, or Firm* — Park, Vaughan, Fleming & Dowler LLP

(57) ABSTRACT

A spray inhibitor for inhibiting the spray of water caused by exhaust gases exiting an exhaust outlet on a powerboat.

28 Claims, 6 Drawing Sheets

EXHAUST SPRAY INHIBITOR

FIELD

This disclosure relates generally to exhaust systems in powerboats, and more specifically, to a mechanism for inhibiting the spray of water caused by exhaust gases exiting a submerged or partially submerged exhaust outlet.

BACKGROUND

Modern day powerboats often are equipped with one or more inboard engines. These engines typically are mounted in an enclosed engine room located below the boat's deck. The engine's positioning in the boat requires that its drive shaft extend through the boat's hull (typically through a stuffing box), through a cutlass bearing held in place by a strut affixed to the boat's hull, and then attached to a propeller. As the engine causes the drive shaft to rotate, the propeller likewise rotates, thereby propelling the boat through the water.

Exhaust produced by the engine also must exit the powerboat. Since simply letting the exhaust exit into the enclosed engine room would quickly choke the room with unhealthy exhaust fumes, powerboat designers have designed various exhaust systems that channel the exhaust outside the boat through an exhaust outlet. The exhaust outlet may be above, below, or straddling the boat's waterline. In other words, the outlet may be unobstructed, obstructed, or partially obstructed by the water in which the boat is floating. Moreover, if the boat is rolling or pitching due to turbulent water conditions, the outlet may vacillate between its unobstructed, obstructed, or partially obstructed conditions.

In any of these conditions, exhaust exits the outlet with such force that any water in its path is sprayed or projected into the atmosphere along with the exiting exhaust. This spray of water can be particularly annoying to anyone (or anything) in its path. For example, the water spray from the exhaust of a boat idling at a dock might spray people or equipment within proximity of the spray. If the water is saltwater, the salt residue (and its corrosive effect) exacerbates the issue. The water spray also is known to be particularly annoying to fishermen fishing from the boat within proximity of the spray.

Not just any means of blocking this water spray is acceptable in many powerboating environments. For example, embodiments that materially retard movement of the boat through the water, that are not suitably immune to the violent nature of the powerboating environment, or that limit the free flow of exhaust gases (especially when backing up) will not suffice. Likewise, embodiments that could interfere with swimming or fishing from the boat are similarly not suitable.

Accordingly, an apparatus is needed for non-obtrusively inhibiting the spray of water caused by exhaust gases exiting a submerged or partially submerged exhaust outlet on a powerboat.

SUMMARY

In one embodiment, the present invention includes a spray inhibitor for inhibiting the spray of water caused by exhaust gases exiting an exhaust outlet on a powerboat. In one embodiment, the spray inhibitor is secured in its spray inhibiting position relative to the exhaust outlet by an attachment device. Other details and other embodiments are described in more detail in the following detailed description.

DRAWINGS

The following drawings form part of the present specification and are included to further demonstrate certain aspects of the invention. While the invention in not limited to the following drawings, it may be better understood by reference to one or more of them in combination with the detailed description of specific embodiments presented herein.

DETAILED DESCRIPTION

Various features and advantageous details of the present invention are explained more fully with reference to the non-limiting embodiments that are illustrated in the accompanying drawings and detailed in the following description. Descriptions of well-known starting materials, processing techniques, components, and equipment are omitted so as not to unnecessarily obscure the invention in detail. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure.

Figure 1:
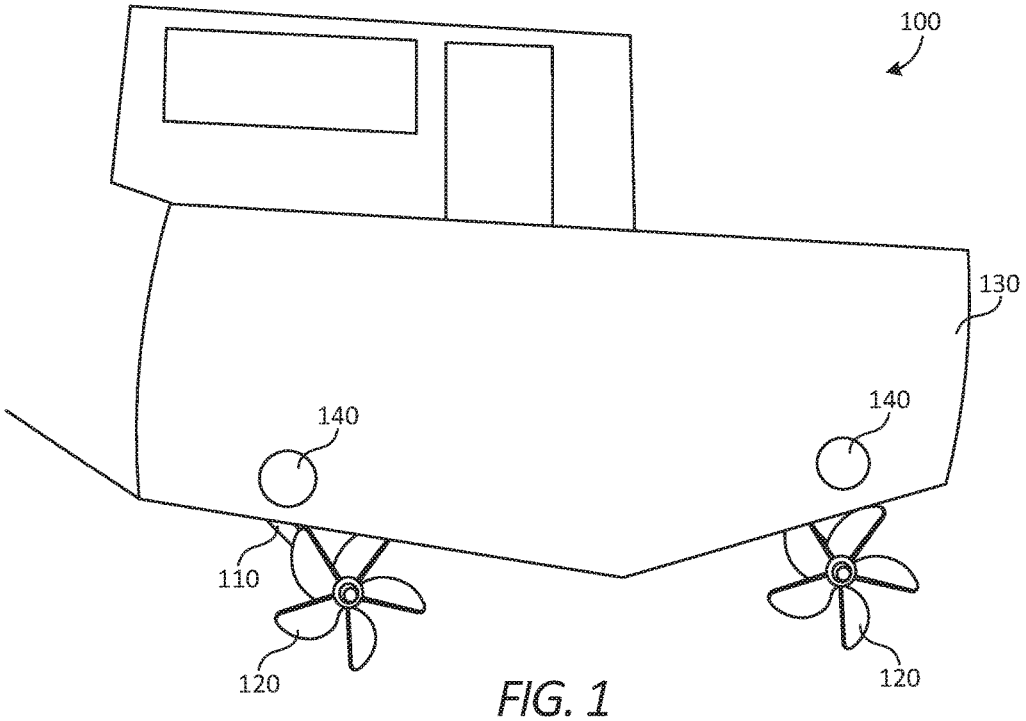
FIG. 1 is a perspective view of the aft portion of a powerboat, with exhaust outlets mounted in the transom.

FIG. 1 is a perspective view of the aft (i.e., rear) portion of a powerboat generally denoted 100. In this particular embodiment, powerboat 100 includes two propellers 120, one of which is shown connected to shaft 110 (the other shaft being obscured due to the perspective angle of the Figure). Mounted in transom 130 are two exhaust outlets 140. As those skilled in the art will appreciate, each exhaust outlet 140 provides an outlet for each of the separate engines (mounted inside the engine room of the boat) that drives propellers 120.

Figure 2:
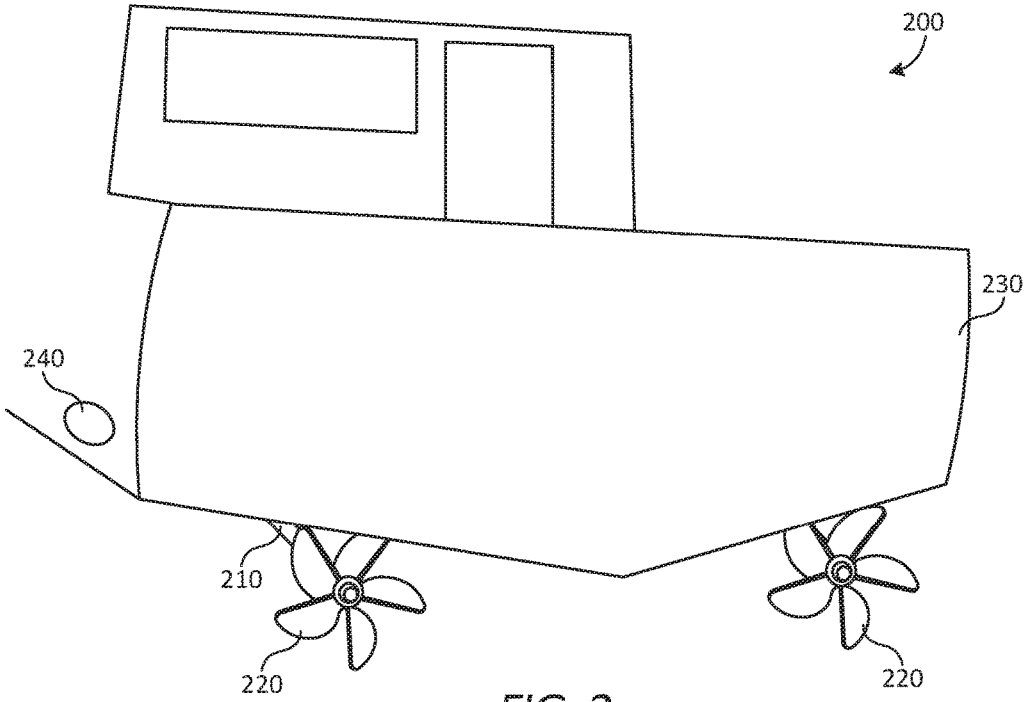
FIG. 2 is a perspective view of the aft portion of a powerboat, with exhaust outlets mounted on the side of the boat.

FIG. 2 is a perspective view of the aft portion of a powerboat generally denoted 200. In this particular embodiment, powerboat 200 includes two propellers 220, one of which is shown connected to shaft 210 (the other shaft being obscured due to the perspective angle of the Figure). As shown in this embodiment, no exhaust outlet is mounted in transom 230; rather, the exhaust outlet 240 is mounted on the lower, back side of the boat. (Another exhaust outlet 240 is located in the same region on the opposite side of the boat, but it is not shown due to the perspective angle of the Figure.) As those skilled in the art will appreciate, each exhaust outlet 240 provides an outlet for each of the separate engines (mounted inside the engine room of the boat) that drives propellers 220.

Figure 3:
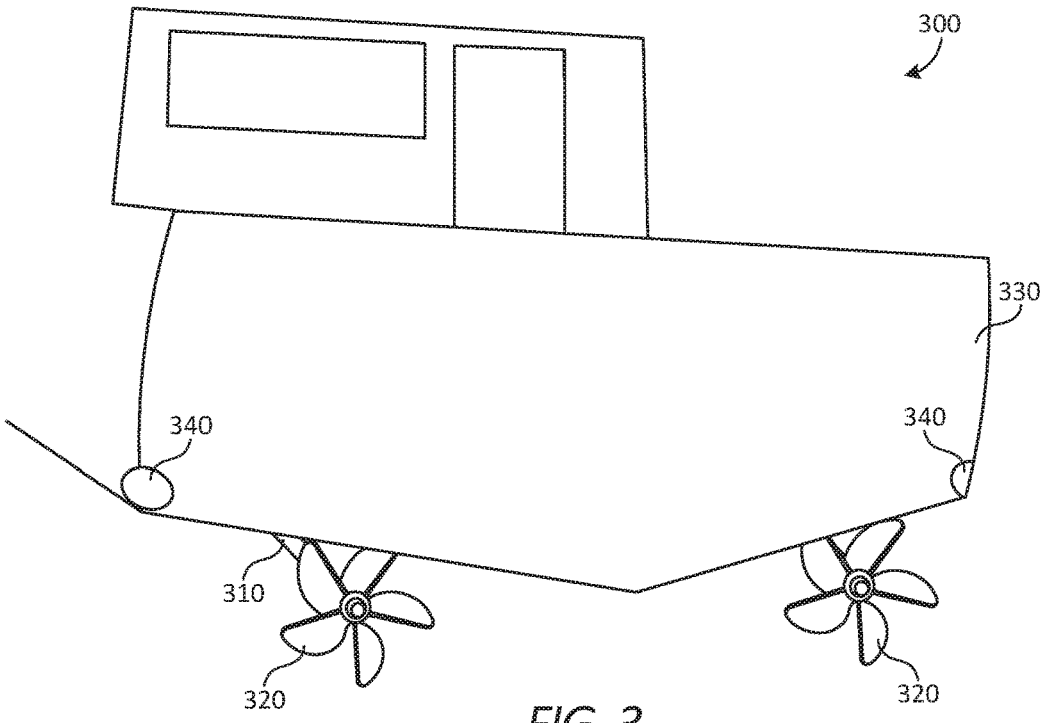
FIG. 3 is a perspective view of the aft portion of a powerboat, with exhaust outlets straddling the transom and side of the boat.

FIG. 3 is a perspective view of the aft portion of a powerboat generally denoted 300. In this particular embodiment, powerboat 300 includes two propellers 320, one of which is shown connected to shaft 310 (the other shaft being obscured due to the perspective angle of the Figure). Partially mounted in transom 330 and in each side of the boat are two exhaust outlets 340. As those skilled in the art will appreciate, each exhaust outlet 340 provides an outlet for each of the separate engines (mounted inside the engine room of the boat) that drives propellers 320.

FIGS. 1-3 show three different locations of the exhaust outlet(s) of a powerboat. It should be recognized, however, that other locations are possible, and that the present invention is not limited to any one or more particular location(s). Nor is the present invention limited by the number of exhaust outlets since, as described in more detail below, the invention contemplates anywhere from one to many outlets.

Figure 4:
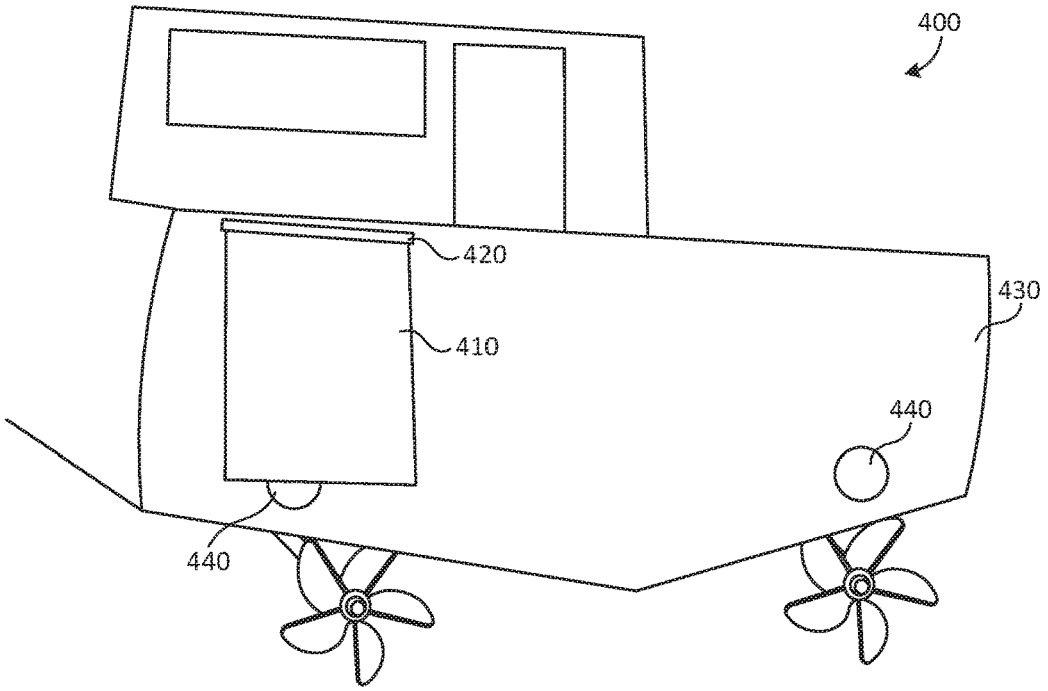
FIG. 4 is a perspective view of the aft portion of a powerboat, having an exemplary exhaust inhibitor associated with one exhaust outlet.

FIG. 4 is a perspective view of the aft portion of a powerboat generally denoted 400. In this particular embodiment, powerboat 400 includes exhaust outlets 440, one of which is partially covered (or blocked) by spray inhibitor 410. Spray inhibitor 410 is affixed to transom 430 by attachment device 420. While spray inhibitor 410 is shown in this particular embodiment as being mounted to transom 430 so that it hangs approximately mid-way across exhaust outlet 440, other positions are contemplated so long as spray inhibitor 410 is positioned relative to outlet 440 so that it substantially inhibits the spray of water caused by exhaust gases exiting a submerged or partially submerged exhaust outlet 440. (Note that while in practice another attachment device 420 and another spray inhibitor 410 typically would be used to similarly inhibit the spray of water caused by exhaust gases exiting the other/opposite exhaust outlet 440, none is shown in FIG. 4 because the invention does not require another one, and also to not unnecessarily clutter the teachings of the Figure.)

Figure 5:
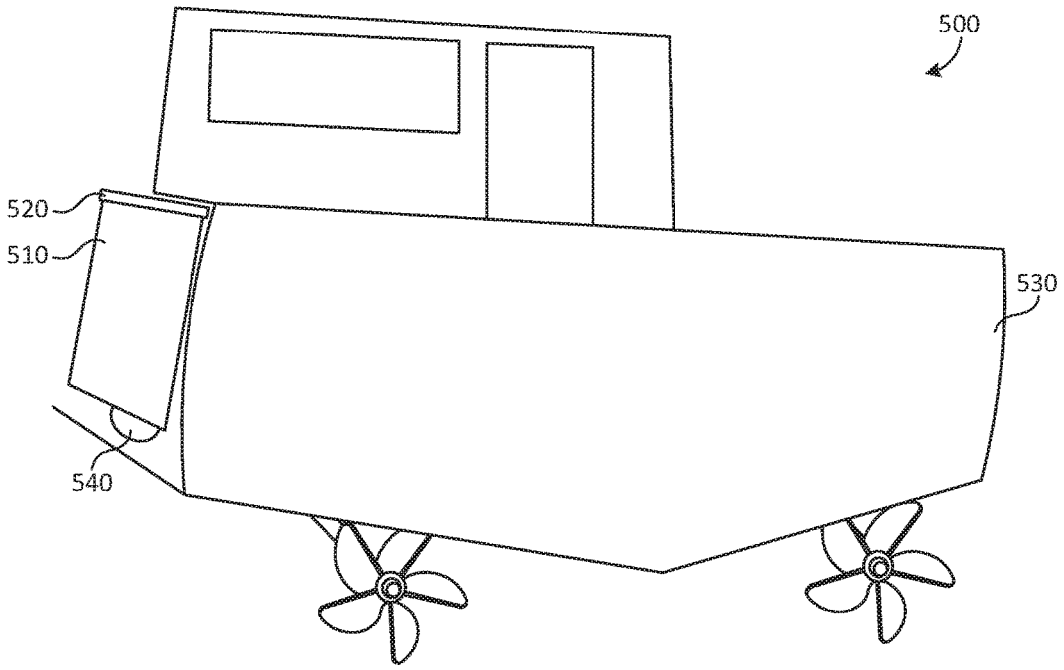
FIG. 5 is a perspective view of the aft portion of a powerboat, having an exemplary exhaust inhibitor associated with one exhaust outlet.
Figure 6:
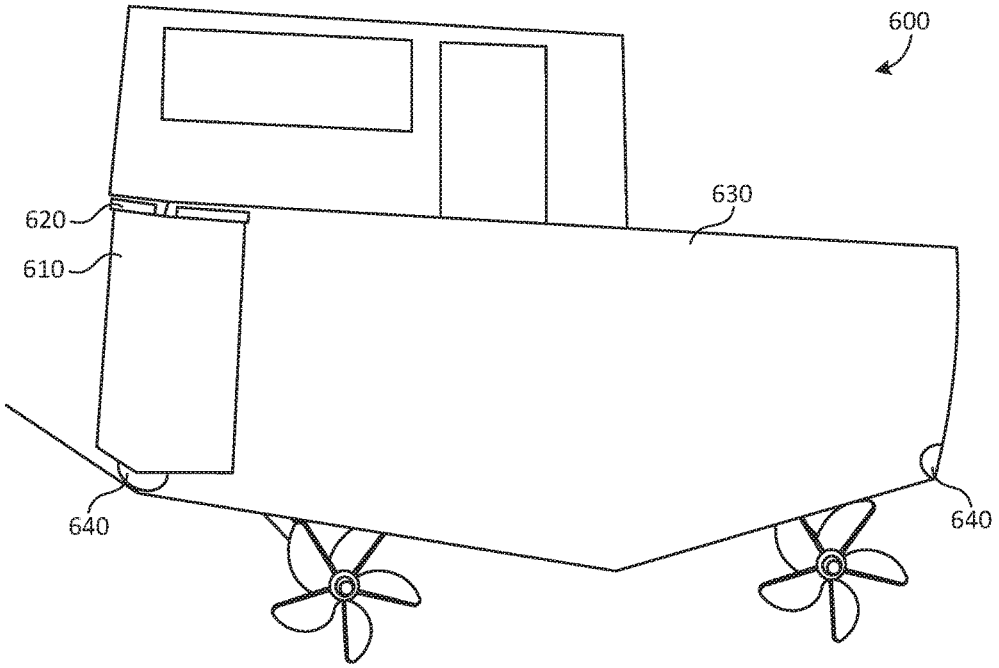
FIG. 6 is a perspective view of the aft portion of a powerboat, having an exemplary exhaust inhibitor associated with both exhaust outlets.

FIG. 5 is a perspective view of the aft portion of a powerboat showing spray inhibitor 510 mounted/positioned on the back side of the powerboat relative to exhaust outlet 540 so that it substantially inhibits the spray of water caused by exhaust gases exiting the submerged or partially submerged outlet 540. Likewise, FIG. 6 is a perspective view of the aft portion of a powerboat showing spray inhibitor 610 mounted/positioned on both the transom 630 and the back side of the powerboat relative to exhaust outlet 640 so that the spray inhibitor substantially inhibits the spray of water caused by exhaust gases exiting the submerged or partially submerged outlet 640. In FIGS. 5-6, as it was with respect to FIG. 4, another attachment device and another spray inhibitor typically (but not necessarily) would be used to similarly inhibit the spray of water caused by exhaust gases exiting the other/opposite exhaust outlet not shown (or not fully shown) due to the perspective angle of the Figures.

Figure 7:
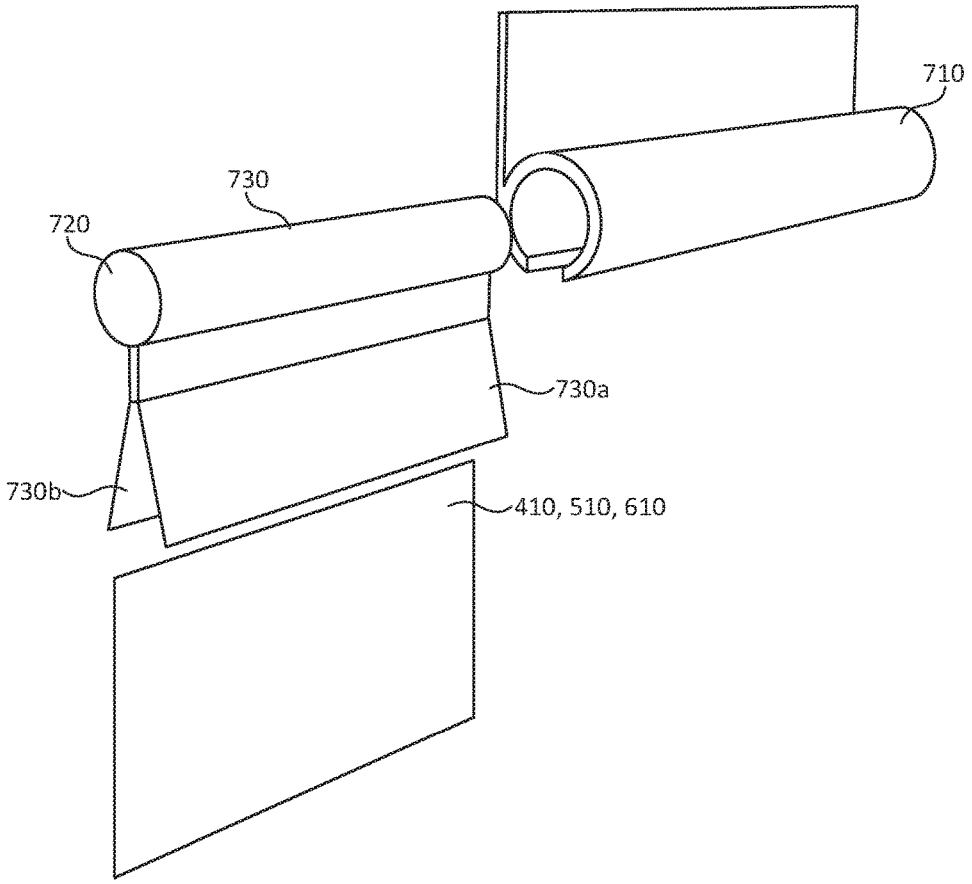
FIG. 7 is an exploded, perspective view of an exemplary attachment device for attaching a spray inhibitor to a powerboat.

While the attachment device (420, 520, 620) can be any device that attaches spray inhibitor (410, 510, 610) so that it is appropriately positioned relative to the exhaust outlet (440, 540, 640), a preferred attachment device is manufactured and sold by Keder Solutions, a division of Made In America, LLC. FIG. 7 illustrates a preferred (but not limiting) Keder attachment comprising three parts: a track, a core, and material forming two flaps. More specifically, FIG. 7 shows track 710, which preferably is made from rigid PVC (as opposed to corrosive aluminum) and has a partially closed circular opening along its length into which core 720 is inserted. Core 720 can be made from extruded PVC, or another elastic material, to allow flexibility. As also shown, core 720 can be wrapped in fabric 730 having exposed fibers on the outside that allow the (now) wrapped core 720 to easily slide into (and out of) track 710. The fabric 730 that wraps core 720 can include two flaps **730*a* and 730*b*, between which the top edge of the spray inhibitor (410, 510, 610**) is placed for welding or sewing thereto.

Figure 8:
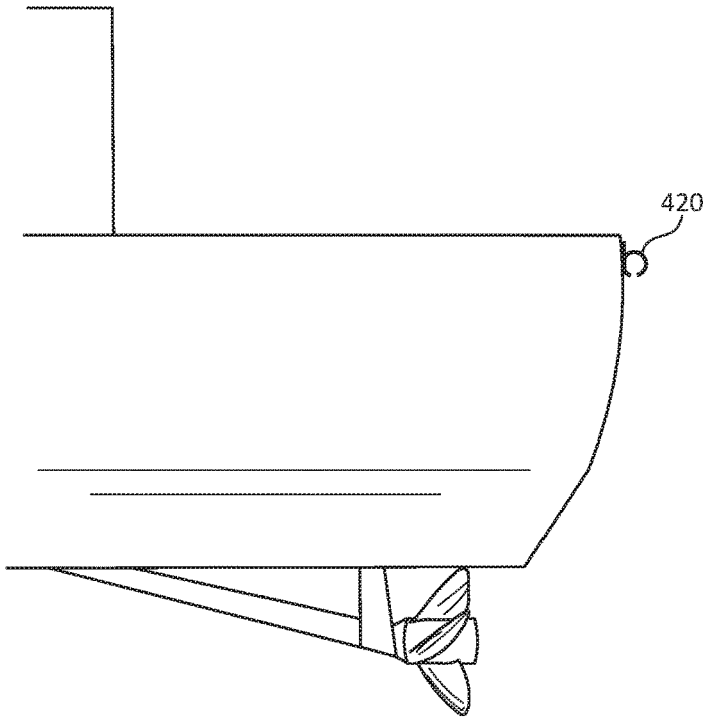
FIG. 8 is a side view of the aft portion of a powerboat.
Figure 9:
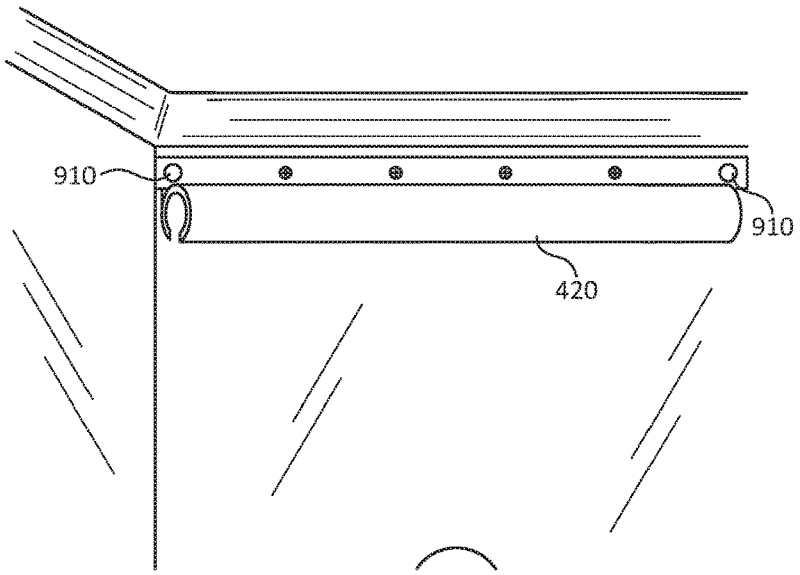
FIG. 9 is a perspective view of one corner of the stern of a powerboat.

Track 710 can be affixed to boat's transom, side, or exhaust outlet by any suitable means, such as screws, rivets, glue, or otherwise, such that the spray inhibitor hangs in its intended, exemplary position as shown in FIGS. 4-6, or to otherwise substantially inhibit the spray of water caused by exhaust gases exiting the submerged or partially submerged exhaust outlet. Since core 720 slides in and out of track 710, some of these arrangements also allow the spray inhibitor (410, 510, 610) to be easily installed or removed from its operating position on the transom (as shown in FIG. 4), on the side of the boat (as shown in FIG. 5), or on both the transom and the side of the boat (as shown in FIG. 6). FIG. 8 is a side view of the powerboat illustrating the positional location of attachment device 420 (from FIG. 4), whereas FIG. 9 is another perspective view (from the rear) of the same attachment device.

Figure 10:
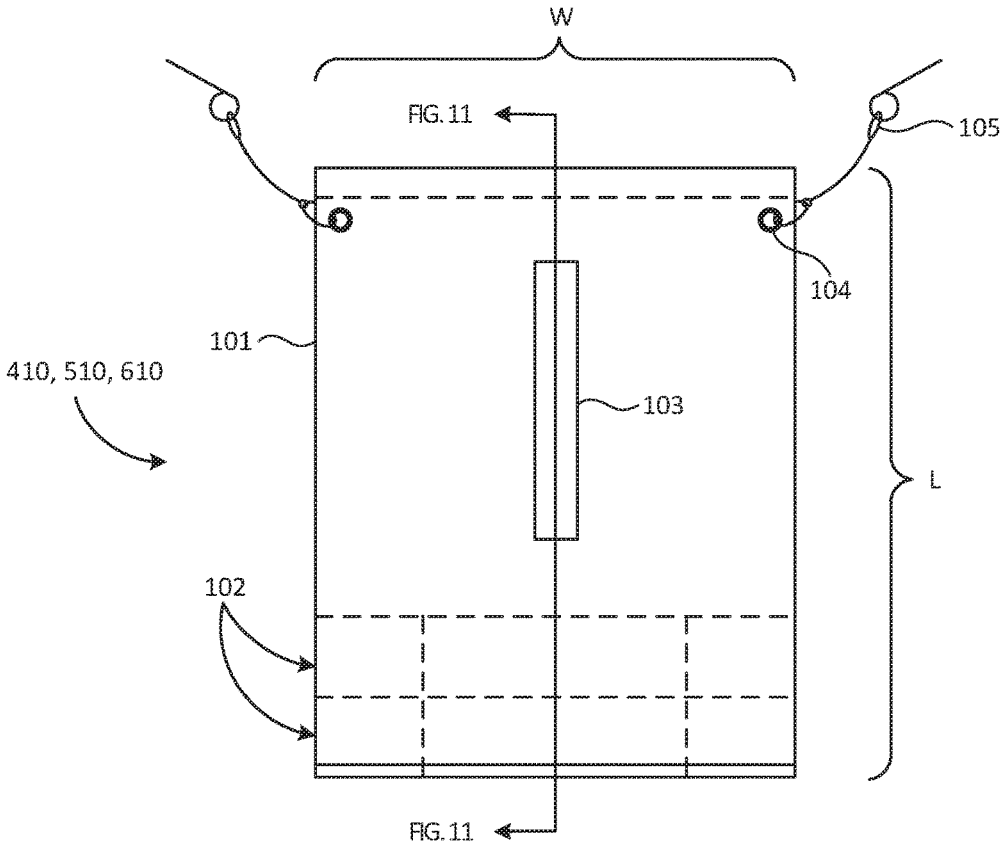
FIG. 10 is a front elevation view of an exemplary embodiment of a spray inhibitor.

FIG. 10 a front elevation view of an exemplary embodiment of spray inhibitor 410, 510, 610. In this embodiment, the length (L) and width (W) of the spray inhibitor are tailored to the dimensions and location of the exhaust outlet, as well as the location of attachment device 420, 520, 620. Specifically, taking into account the location of the attachment device, the length and width of the spray inhibitor should be sufficient to substantially inhibit the spray of water caused by exhaust gases exiting the submerged or partially submerged exhaust outlet.

While not specifically shown in FIG. 10, this particular embodiment contemplates that the spray inhibitor is made from two layers of neoprene material 101. (Using a single or more than two layers also is contemplated.) Using two layers makes it simple to insert one or more weights (not shown) between the two layers, and to sew around the weights to form "pockets" that keep the weights in place. FIG. 10 shows an exemplary embodiment having two rows 102 of such pockets toward the bottom of the spray inhibitor. The weights can serve multiple purposes. For example, locating the weights toward the bottom of the spray inhibitor helps retard wind and/or water forces that might otherwise dislodge the inhibitor from its spray inhibiting location relative to the exhaust outlet. Likewise, locating more weight on the outside of the inhibitor allows it to better trap water spray that might otherwise escape around one or both sides of the inhibitor.

FIG. 10 also illustrates an embodiment of spray inhibitor 410, 510, 610 having handle 103. Handle 103 can be made of any material and attached to the spray inhibitor in any manner that permits raising the spray inhibitor from its position relative to the exhaust outlet. For example, handle 103 can be used to pull the spray inhibitor into the boat. This is especially easy if the attachment device includes track 710 and core 720 because core 720 rotates within track 710, thereby allowing the majority of the spray inhibitor to be pulled over the stern of the boat.

FIG. 10 also illustrates an embodiment of spray inhibitor 410, 510, 610 having one or more rings 104 and tie-down devices 105. As described, when using an attachment device such as the embodiment described in FIG. 7, the entire spray inhibitor slides on core 720 through track 710. To prevent this embodiment of the spray inhibitor from sliding out of position (due to wind, waves, water, boat movement, or otherwise), one or more rings 104 and tie-down devices 105 are provided. Specifically, in this embodiment, tie-down device 105 includes a pin attached to a cord, which is then attached to ring 104. The pin then is attached to the boat, thereby ensuring that core 720 does not slide substantially out of its spray inhibiting position relative to the exhaust outlet. Referring back to FIG. 9, pin connection 910 is shown as one possible location for inserting the pin of tie-down device 105 on either side of the spray inhibitor. In yet another embodiment, the cord on tie-down device 105 can be elastic to provide some stretch so that the length of the cord and/or location of its connection point on the boat do not have to be precise.

Figure 11:
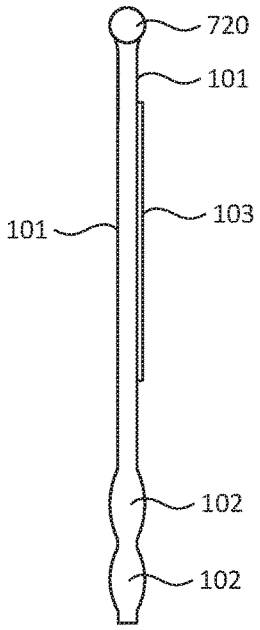
FIG. 11 is a cross section of an exemplary embodiment of the spray inhibitor of FIG. 10.

FIG. 11 is a cross section of FIG. 10 along the noted cross section designation. FIG. 11 contemplates the exemplary embodiment in which the attachment device is that shown in FIG. 7 (i.e., employing core 720), and the spray inhibitor includes two layers of material with two rows of pockets. Specifically, FIG. 11 shows core 720, spray inhibitor layers 101, pockets 102, and handle 103. Different combinations and configurations will be apparent to those skilled in the art.

Although the invention(s) is/are described herein with reference to specific embodiments, various modifications and changes can be made without departing from the scope of the present invention(s), as set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature, or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes," or "contains" one or more elements possesses those one or more elements but is not limited to possessing only those one or more elements. Similarly, a method or process that "comprises," "has," "includes," or "contains" one or more operations possesses those one or more operations but is not limited to possessing only those one or more operations.

The invention claimed is:

1. A boat, comprising:

an exhaust outlet; and a spray inhibitor attached to a region of the boat other than the exhaust outlet;

whereby the spray inhibitor inhibits a spray of water caused by exhaust gases exiting the exhaust outlet.

2. The boat of claim 1 wherein the spray inhibitor is attached to the boat with an attachment device.

3. The boat of claim 2 wherein the attachment device positions the spray inhibitor relative to the exhaust outlet to inhibit the spray of water caused by exhaust gases exiting the exhaust outlet.

4. The boat of claim 3 wherein the attachment device is attached to the boat above the exhaust outlet.

5. The boat of claim 4 wherein the spray inhibitor is removably attached to the boat.

6. The boat of claim 5 wherein the attachment device comprises a track, a core, and material forming two flaps.

7. The apparatus of claim 6 wherein the track is secured to the boat, and the core slides through, and is able to rotate within, the track.

8. The apparatus of claim 7 wherein the spray inhibitor is secured between the two flaps of the attachment device.

9. The apparatus of claim 8 wherein the spray inhibitor further comprises two layers of material.

10. The apparatus of claim 9 wherein the spray inhibitor further comprises one or more weights between the two layers of material.

11. The apparatus of claim 10 wherein the spray inhibitor further comprises a tie-down device.

12. The apparatus of claim 11 wherein the tie-down device attaches to the boat to ensure that the spray inhibitor does not slide substantially out of position relative to the exhaust outlet.

13. The apparatus of claim 12 wherein the spray inhibitor further includes a handle.

14. A spray inhibitor for inhibiting a spray of water caused by exhaust gases exiting an exhaust outlet on a boat, wherein the spray inhibitor includes an attachment device for attaching the spray inhibitor to a region of the boat other than the exhaust outlet.

15. The spray inhibitor of claim 14 wherein the attachment device is configured to position the spray inhibitor relative to the exhaust outlet on a boat to inhibit the spray of water caused by exhaust gases exiting the exhaust outlet.

16. The spray inhibitor of claim 15 wherein at least part of the attachment device is configured to attach to a boat above the exhaust outlet.

17. The spray inhibitor of claim 16 wherein the attachment device comprises a track, a core, and material forming two flaps.

18. The spray inhibitor of claim 17 wherein the core slides through, and is able to rotate within, the track.

19. The spray inhibitor of claim 18 wherein a portion of the spray inhibitor is secured between the two flaps of the attachment device.

20. The spray inhibitor of claim 19 further comprising two layers of material.

21. The spray inhibitor of claim 20 further comprising one or more weights positioned between the two layers of material.

22. The spray inhibitor of claim 21 further comprising a tie-down device.

23. The apparatus of claim 22 wherein the spray inhibitor further includes a handle.

24. The apparatus of claim 22 wherein the tie-down device ensures that the spray inhibitor does not slide substantially out of position relative to the exhaust outlet.

25. The spray inhibitor of claim 14 wherein the spray inhibitor further comprises at least one layer of material.

26. The spray inhibitor of claim 25 wherein the at least one layer of material further includes at least one weight attached thereto.

27. The spray inhibitor of claim 16 wherein the attachment device allows the spray inhibitor to hang from a boat.

28. The spray inhibitor of claim 27 wherein the spray inhibitor is attached to the attachment device at a first end of the spray inhibitor, and a second end of the spray inhibitor hangs relative to the exhaust outlet on a boat to inhibit the spray of water caused by exhaust gases exiting the exhaust outlet.

* * * * *